US010113844B1

(12) United States Patent
Wood

(10) Patent No.: US 10,113,844 B1
(45) Date of Patent: Oct. 30, 2018

(54) MISSILE, CHEMICAL PLASM STEERING SYSTEM, AND METHOD

(71) Applicant: LOCKHEED MARTIN CORPORATION, Bethesda, MD (US)

(72) Inventor: James Richard Wood, Grapevine, TX (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 33 days.

(21) Appl. No.: 15/358,079

(22) Filed: Nov. 21, 2016

(51) Int. Cl.
*F42B 10/66* (2006.01)
*F42B 10/00* (2006.01)

(52) U.S. Cl.
CPC ..... *F42B 10/668* (2013.01)

(58) Field of Classification Search
CPC ..... F42B 10/668; F42B 15/01; F42B 10/02; F42B 10/38; F42B 10/66; B64C 21/00; B64C 21/04; B64C 23/005
See application file for complete search history.

(56) References Cited

U.S. PATENT DOCUMENTS 4,967,982 A 11/1990 Bagley
5,533,331 A 7/1996 Campbell et al.
6,036,144 A 3/2000 Sisk
6,199,484 B1 3/2001 Martinez-Tovar et al.
RE37,331 E 8/2001 Schroeder
7,002,126 B2 * 2/2006 Gnemmi et al. ..... F42B 10/66
7,494,705 B1 2/2009 Sheridan et al.
7,610,747 B2 11/2009 Kim et al.
7,624,941 B1 * 12/2009 Patel et al. ..... F42B 10/668
7,645,969 B2 * 1/2010 Gnemmi et al. ..... F42B 10/668
7,762,498 B1 7/2010 Henderson et al.
7,775,286 B2 8/2010 Duphorne
7,954,768 B1 * 6/2011 Patel et al. ..... F42B 10/668
7,988,101 B2 * 8/2011 Osborne et al. ..... B64C 23/005
8,016,246 B2 * 9/2011 Schwimley et al. .... B64C 21/00
8,038,102 B2 10/2011 Miller et al.
8,134,103 B2 3/2012 Luu et al.
(Continued)

FOREIGN PATENT DOCUMENTS

FR 2846081 A1 * 4/2004 ..... F42B 10/66

OTHER PUBLICATIONS

Gnemmi et al., "Guidance of a Supersonic Projectile by Plasma-Actuation Concept," Intech, Jul. 27, 2011.

*Primary Examiner* — Bernarr E Gregory
(74) *Attorney, Agent, or Firm* — Terry M. Sanks, Esq.; Beusse Wolter Sanks & Maire, PLLC

(57) ABSTRACT

Embodiments disclosed include a system comprising a missile segment having an external surface conforming to a portion of an external surface of a missile body. The missile segment comprising a plurality of chemical plasma dispensing units (CPDUs) having a chemical plasma reactant (CPR). Each CPDU is addressable so that a group of selected CPDUs in an area is ignited simultaneously to cause a first reaction to push CPR particles into a flow stream surrounding the missile body. The CPR particles to complete a second reaction in the flow stream over a reaction time period to effectuate production of expanding hot gas energy caused by heating air in the flow stream and gaseous reaction products over the missile body to provide an amount of a steering force to change one or more of six degrees of freedom at a location on the body. A missile and method are also provided.

20 Claims, 8 Drawing Sheets

(56) References Cited

U.S. PATENT DOCUMENTS

| | | | | |
|---|---|---|---|---|
| 8,190,305 | B1 * | 5/2012 | Prince et al. | F42B 10/668 |
| 8,267,355 | B1 * | 9/2012 | Patel et al. | F42B 10/668 |
| 8,336,826 | B2 | 12/2012 | Janson | |
| 8,735,788 | B2 | 5/2014 | Preston et al. | |
| 9,429,400 | B1 * | 8/2016 | Sowle et al. | F42B 10/02 |
| 9,541,106 | B1 * | 1/2017 | Patel et al. | B64C 21/00 |
| 9,637,223 | B1 * | 5/2017 | Dicocco et al. | B64C 21/00 |
| 9,637,224 | B2 * | 5/2017 | Nikic | B64C 21/04 |
| 9,834,301 | B1 * | 12/2017 | Patel et al. | F42B 10/38 |
| 2006/0131282 | A1 | 6/2006 | Miller et al. | |

* cited by examiner

MISSILE, CHEMICAL PLASM STEERING SYSTEM, AND METHOD

FIELD OF DISCLOSURE

Embodiments generally relate to a missile, a chemical plasma steering system, and method.

BACKGROUND

Missiles include seeker systems with detection range requirements which can be relatively expensive to implement. To reduce the detection range requirements, the missile airframe maneuver time constant is reduced, which in turn reduces the detection and tracking range requirements of the seeker system. One of the challenges is that interior volumes of the missile are filled with components of conventional attitude control motors (ACMs) used for flight maneuverability. The ACMs are relatively heavy and compete for volume in the missile with other missile subsystems. Thus, adding more ACMs for a reduced detection range requirement may significantly affect the flight performance of the missile. Current missile seeker systems have large angles of attack in tracking and endgame maneuvers. With conventional attitude control motors (ACMs) reducing the seeker look angle requirements reduces cost and complexity of the seeker subsystem. To reduce the seeker look angle requirements, adding the ACM sections ahead of and behind the missile center of gravity and center of pressure as may be required.

Conventional attitude control motors (ACM) devices include high pressure containment of the energetic reactants. The reactants also have a specified combustion rate to produce the thrust effects propositional to the propellant mass ejected with high acceleration out from the high pressure containment. The ACM devices may include thrusters.

SUMMARY

Embodiments disclosed herein relate to a missile, a chemical plasma steering system, and method. An aspect of the embodiments includes a system comprising a missile segment having an external surface conforming to an external surface of a portion of a missile body. The missile segment comprises a plurality of shallow cavities arranged in the external surface of the portion of the missile body. Each cavity has an opening. The system includes a plurality of chemical plasma dispensing units (CPDUs) having a chemical plasma reactant (CPR). Each respective CPDU is coupled in a respective cavity and being individually addressable so that a group of selected CPDUs in an area is ignited simultaneously to cause a first reaction to push CPR particles into a flow stream surrounding the missile body. The CPR particles to complete a second reaction in the flow stream over a reaction time period to effectuate production of expanding hot gas energy caused by heating air in the flow stream and gaseous reaction products over the missile body to provide an amount of a steering force to change one or more of six degrees of freedom at a location on the missile body which lags the area defined by the group of selected CPDUs.

An aspect of the embodiments includes a missile comprising a missile body having a nose section, a forward section, an aft section, and a tail section. The missile comprises a computing device configured to control steering of the missile body in air and at least one missile segment having an external surface conforming to an external surface of the missile body. The at least one missile segment being integrated in the missile body. The at least one missile segment comprising a plurality of chemical plasma dispensing units (CPDUs) embedded in the external surface of the at least one missile segment and having a chemical plasma reactant (CPR). Each respective CPDU is individually addressable so that a group of selected CPDUs in an area is ignited simultaneously to effectuate production of expanding hot gas energy to cause overpressure in a flow stream with gaseous reaction products over the missile body to provide an amount of a steering force to change one or more of six degrees of freedom at a location on the missile body which lags the area defined by the group of selected CPDUs.

Another aspect of the embodiments includes a method comprising: determining, by at least one processor, an amount of steering force needed to cause a certain amount of missile body translation along at least one section of a missile body; determining, by the at least one processor, a group of chemical plasma dispensing units (CPDUs) of a plurality of CPDUs needed to produce the steering force based on an amount of a chemical plasma reactant (CPR) of each CPDU, the group of CPDUs being in an area; igniting, simultaneously, the group of CPDUs, to release CPR particles in a flow stream around the missile body; and effectuating production of expanding hot gas energy by the released CPR particles to cause overpressure in the flow stream with gaseous reaction products over the missile body to provide the amount of the steering force which changes one or more of six degrees of freedom at a location on the missile body which lags the area defined by the group of selected CPDUs.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
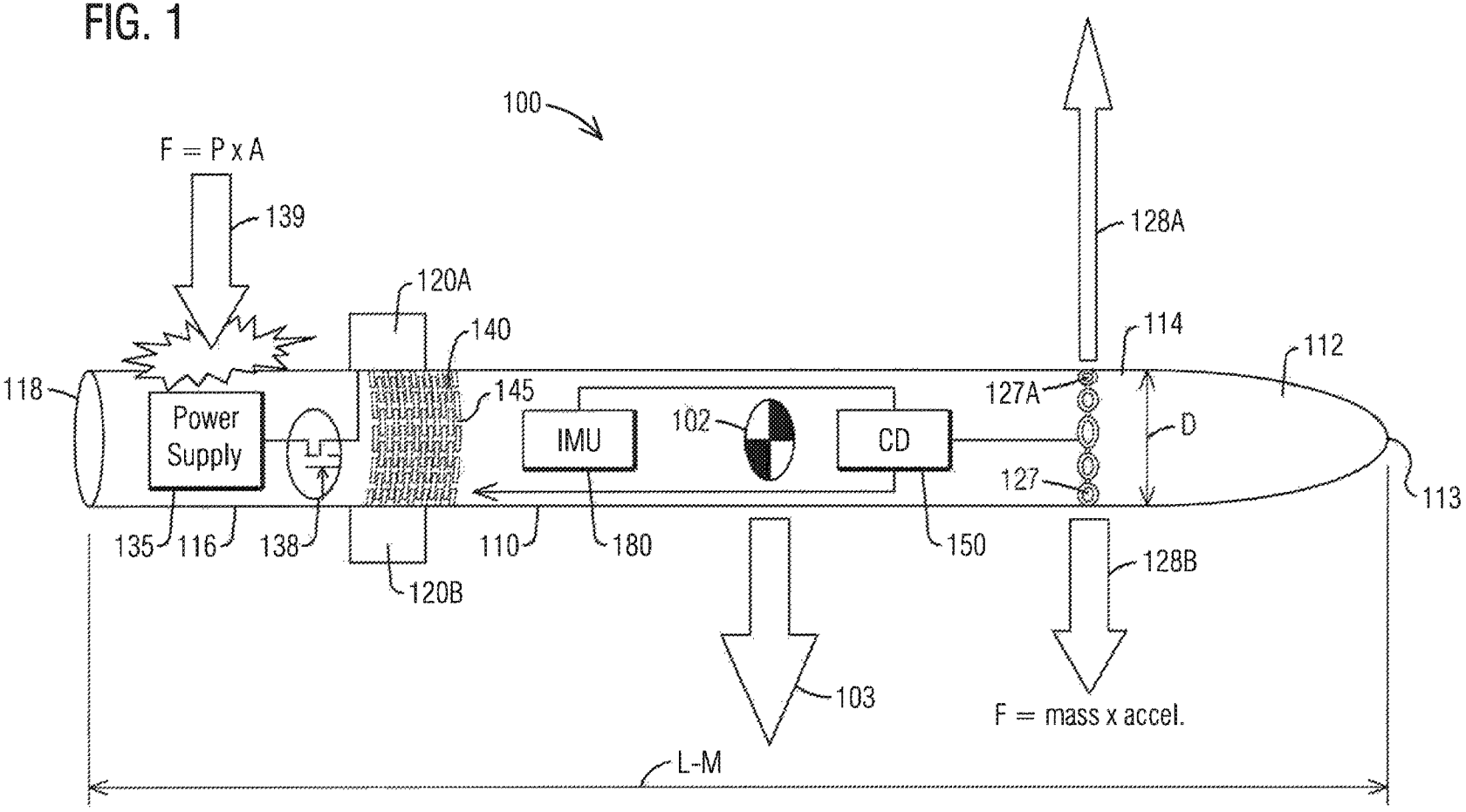
FIG. 1 illustrates a view of a missile with a chemical plasma steering system.

Embodiments are described herein with reference to the attached figures wherein like reference numerals are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, will readily recognize that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

The embodiments herein may enable lowering the high costs of missile seeker systems by reducing their detection range requirements. For example, the missile airframe maneuver time constant is reduced, which in turn reduces the detection and tracking range requirements of the missile seeker system.

The embodiments herein may enable interior volumes of the missile body to be opened up relative to conventional attitude control motors (ACMs) which relaxes the seeker system and other subsystem miniaturization costs and risks.

The embodiments herein may further reduce complexity and costs in missile seeker systems by reducing large angles of attack (AoA) in tracking and endgame maneuvers which reduces seeker look angle requirements.

The chemical plasma steering system described herein does not use a high pressure containment of the energetic reactants from which propellant mass is ejected with high acceleration out from the high pressure containment.

The embodiments herein are directed to, for example, guided projectiles, guided missiles for surface to air, air-to-air, air-to-ground, and ground-to-ground guided artillery rounds.

FIG. 1 illustrates a view of a missile 100 with a chemical plasma steering (CPS) system. The missile 100 includes a missile body 110 comprising a point of center of gravity 102. The missile body 110 may comprise a nose section 112, a forward body section 114, an aft body section 116 and a tail end 118. The missile body 110 may also comprise fins or control surfaces 120A and 120B positioned to extend or radiate from the missile body 110. The forward body section 114, the aft body section 116, and the tail end 118 of the missile body 110 may have a generally hollow tubular shape having a diameter D. The nose section 112 may taper gradually to the tip or apex 113 of the nose section 112. The nose section 112 may have a first end which interfaces with an end of the forward body section 114. The nose section 112 may have a conical shape or may have a rounded nose cone shape where the apex 113 may be generally rounded. The missile body has a length L-M. For the sake of brevity, the missile body 110 and missile 100 may include other components and subsystems not shown herein which are known in the art to carry out the functions of a missile.

The forward body section 114 may comprise an attitude control motor (ACM) section 127. The ACM section 127 may include a hollow tubular section which includes a plurality of ACM devices 127A circumferentially spaced around the hollow tubular section. The hollow tubular section may have a diameter D which is the same as the diameter of the missile body 110. The ACM devices 127A may be, by way of non-limiting example, thrusters which may expel a force through an outlet (denoted as a circle) of a thruster. The outlet being a hole, opening or jet formed in the hollow tubular section. The AMC section 127 may include high pressure containment containers which are not shown.

The missile 100 may comprises a computing device (CD) 150 which will be described in more detail in relation to FIG. 9. The missile 110 may include explosives, seeker system, and other devices not shown for the sake of brevity. The missile 100 may include an inertial measurement unit (IMU) 180 to determine the pitch, yaw and roll of the missile. The IMU 180 may include accelerometers, gyroscopes, and/or magnetometers. The CD 150 may receive measurements from the IMU 180 to determine six degrees of freedom corresponding to a location of the missile body 110 in air or fluid medium during flight. The six degrees of freedom may include x, y and z coordinates of a Cartesian coordinate system and the pitch, yaw and roll. By way of non-limiting example, the seeker system may include one of an active or passive radar system, an infrared seeker system, and light detection and ranging (LIDAR) system.

The plurality of ACM devices 127A may be configured to be controlled by the CD 150 to affect and control the maneuverability of the forward body section 114 such as to navigate the missile body 110 along a flight path, such as without limitations, to a hit and kill endgame. In some embodiments, the plurality of ACM devices 127A may be used to obtain a desired angle of attack (AoA) by selectively activating any one or more ACM devices to cause, by way of example, rotation or pivot of the forward body section 114. The ACM devices 127A may be located to emit a jet force, under high pressure, in the direction of arrow 128A from the external surface of the missile body 110 to produce a force in the direction of arrow 128B. The force at arrow 128B is define by equation Eq(1) where $$\text{Force}_{ACM}=\text{Mass}\times\text{Acceleration}. \qquad \text{Eq(1)}$$

The ACM device locations along the missile body 110 allow maneuvers both for an angle of attack (AoA) and/or translation of the missile body 110.

By way of non-limiting example, the ACM devices 127A may be configured to produce a force in a positive z-direction to rotate the nose section in the positive z-direction or a negative force. By way of example, the positive z-direction may provide a negative pitching moment. The negative force may slow a downward rotation of the missile body 110. An example, of the ACM devices is described in U.S. Reissued Pat. No. RE37,331, titled "DUAL-CONTROL SCHEME FOR IMPROVED MISSILE MANEUVERABILITY," assigned to Lockheed Martin Corporation, and which is incorporated herein by reference as if set forth in full below.

The plurality of ACM devices 127A create a force by the combustion of reactants generally stored in a high pressure containers and ignited by an ignitor. The thruster nozzles and/or other subsystems to control the combustion and acceleration of the reaction product mass to create the necessary force (i.e., $force_{ACM}$). The combustion products are accelerated out of expansion nozzles of thrusters of ACM devices 127A. Thus, traditional ACM systems, such as those using thrusters, occupy valuable space within the volume of the missile body 110 and add weight to the missile body 110. The weight of the missile body 110 affects the overall rocket motor fuel amount to complete the flight path to the intended target.

The missile 100 may further comprise a missile chemical plasma steering (CPS) system which may comprise at least one power supply 135, a switch array 138 (only one shown), a chemical plasma steering (CPS) segment 140 coupled to the CD 150 and having a plurality of cavities 145, each being filled a chemical plasma dispensing unit (CPDU) 446A or 446B (FIG. 4A or 4B) having a quantity (q) of chemical plasma reactant (CPR), as will be described in more detail below. The power supply 135 may include pulse power. The switch array 138 may include integrated circuits. While one CD 150 is shown, the missile 100 may include a plurality of CDs or processors which may be distributed in the missile body 110 with at least one CD being use for the missile CPS system. In some embodiments, the CPS system may include a computing device (CD) or processor. The details of the CPS segment 140 will be described in more detail in relation to FIGS. 3A, 3B, 4A, and 4B. The CPS segment 140 is configured to be controlled to generate a force (hereinafter "$force_{CPS}$") in the direction of arrow 139 wherein the $force_{CPS}$ is defined by equation Eq(2) where $$Force_{CPS}=Pressure\ (P)\times area\ (A). \qquad Eq(2)$$

The $force_{CPS}$ in the direction of arrow 139 and the $force_{ACM}$ in the direction of arrow 128B produce a net missile motion force in the direction of arrow 103. The net missile motion force in the direction of arrow 103 being from both forces (i.e., $force_{CPS}$ and $force_{ACM}$) in translation, for some embodiments.

Figure 2:
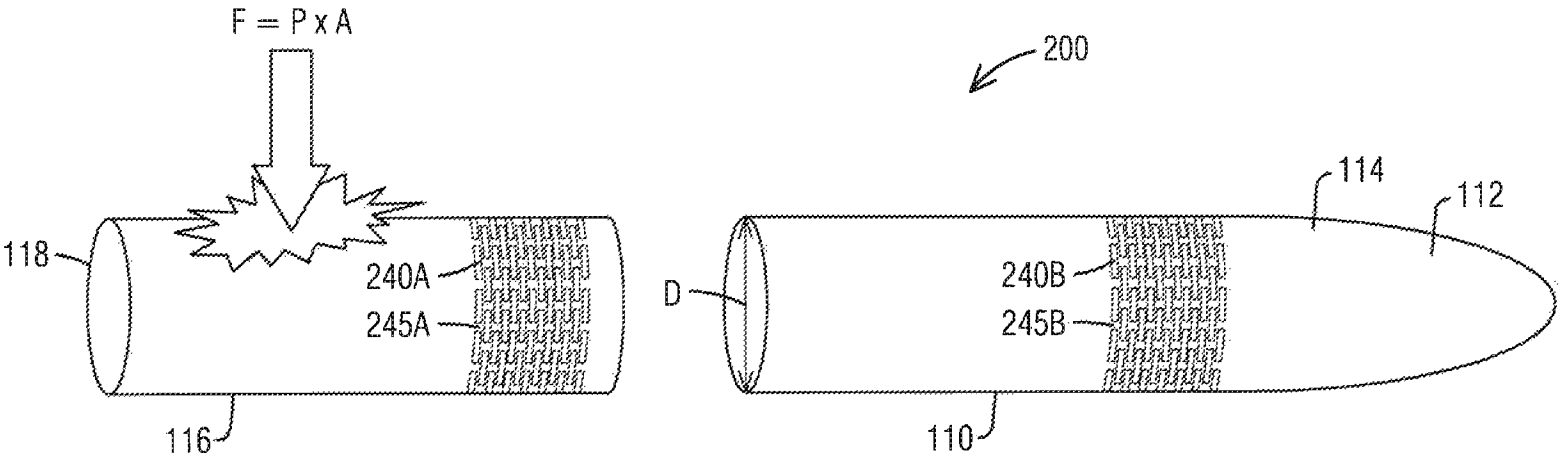
FIG. 2 illustrates a view of a missile with a plurality of chemical plasma steering systems.

FIG. 2 illustrates a view of a missile 200 with a plurality of chemical plasma steering (CPS) segments 240A and 240B. The missile 200 is essentially the same as the missile 100 so only the differences will be described for the sake of brevity. The missile 200 may include a first CPS segment 240A located at the aft body section 116 and the second CPS segment 240B located in the forward body section 114. The second CPS segment 240B may replace traditional ACM devices described in the embodiment of FIG. 1. Each of the CPS segments 240A and 240B may include a plurality of CPR devices 245A and 245B, respectively. Nonetheless, the missile body 110 may include one or more CPS segments 240A and 240B.

Figure 3A:
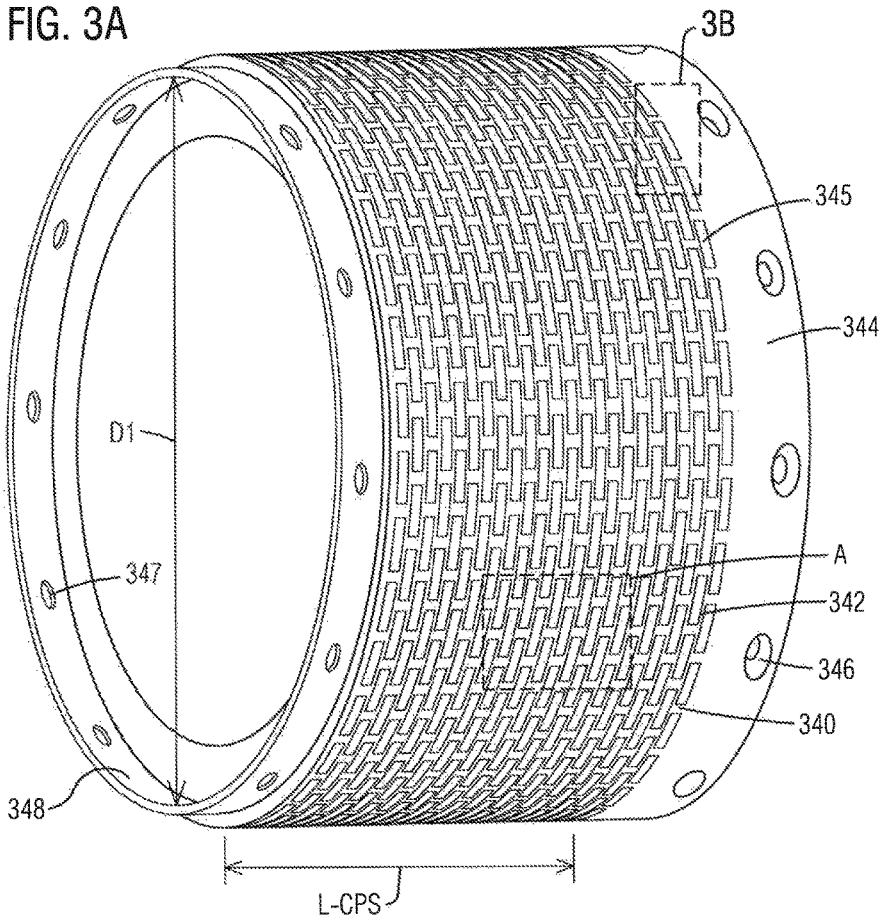
FIG. 3A illustrates a chemical plasma steering segment.
Figure 3B:
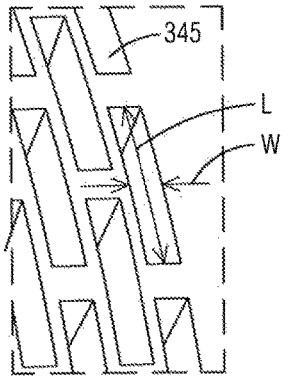
FIG. 3B illustrates a partial view of the chemical plasma steering segment at box 3B in FIG. 3A.

FIG. 3A illustrates a chemical plasma steering (CPS) segment 340 (i.e., CPS segment 140). FIG. 3B illustrates a partial view of the chemical plasma steering (CPS) segment in box 3B in FIG. 3A. The CPS segment 340 includes a generally hollow cylindrical body 342 which has a diameter D1 which may generally fit within the diameter D as the missile body 110. The hollow cylindrical body 342 may comprise a cylindrical wall having formed or embedded therein a plurality of cavities 345 arranged in a certain configuration. Each cavity may be a hollow groove or trench having an opening which begins with the outermost external surface of the segment 340 and extends the area of the cavity.

By way of example, the plurality of cavities 345 are arranged in rings circumferentially arranged around the body 342. A ring of cavities 345 are formed such that each cavity is separated and linked to the next cavity in series by a gap of segment material remaining between the hollowed area of the groove or trench defining the cavity 345. Furthermore, each ring is separated from an adjacent ring by a continuous ring of segment material remaining between adjacent rings.

The CPS segment 340 comprises a plurality of rings of cavities. By way of non-limiting example, the cavities of adjacent rings are staggered. A midpoint of a cavity of adjacent rings may be offset. In some embodiments, all of the cavities 345 have the same size. However, in some embodiments, some of the cavities may have varying sizes. As shown in FIG. 3B, each cavity has a width W and length L. The opening of the cavity to the air (external to the missile body) allows the chemical plasma reaction to vent under low pressures into the air. The opening dimensions may correspond essentially to the same width W and length L of the cavity. The cavity 345 also includes a height or depth (not shown). The area of the plurality of rings in the segment 340 has a length of L-CPS. The length L-CPS and the volume of the cavity 340 to store and house the chemical plasma reactant (CPR) 465 (FIG. 4A) determines the amount or quantity of grams of reactant (CPR) to be individually selected to produce the exothermic reactions. In operation, multiple exothermic reactions may be generated at different areas along the CPS segment 340 over the time of the flight. The CPR 465 may be an energy shot (CPR)<1 gram (g) of reactive metal. The CPR reaction may be complete in <100 μsec. In some embodiments, the reaction time period may be from 10-100 μsec.

The CPS segment 340 may include a first end band 344 with a plurality of holes 346 configured to receive a fastener (not shown) to couple the first end band 344 to the missile body 110. The missile body 110 may include a corresponding band which would slip within the diameter of the first end band 344. The CPS 340 may include a second end band 348 having a hole 347 formed therein for the attached of the second end band 348 to a portion of the missile body 110. The diameter D1 of the second end band 348 is smaller than the diameter of the missile body 110 and is to be inserted into the diameter D of the missile body so that the missile body 110 and the second end band 348 may be secured together. The overall diameter of the CPS segment 340 may correspond to the diameter D of the missile so that the CPS segment 340 has generally the same circumference as the missile body 110. In some embodiments the CPS segment 340 would confirm to the geometry of the missile body section where the CPS segment is installed. For control surfaces, the CPS segment would conform to the surface profiles of the control surface.

In FIG. 3A, a square, denoted as a dash lines, represents a possible selected area A described in more detail later. The area A may be calculated by the CD 150 to deliver a certain $force_{CPS}$ or pressure to effectuate a change in missile body location while in flight. The change in missile body location may change one or more of the six degrees of freedom based on measurements by the IMU 180, for example, for a translation or angle of attack (AoA) for a hit to kill endgame.

Figure 4A:
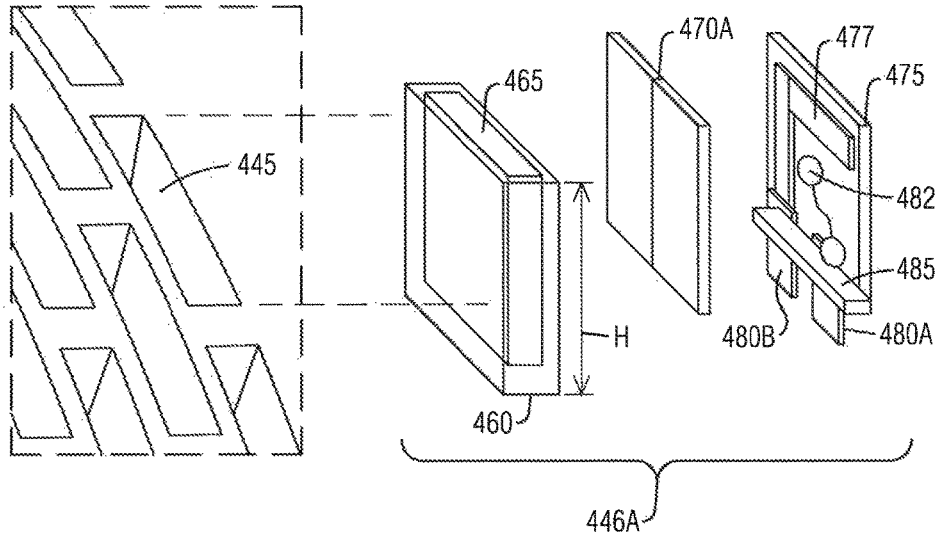
FIG. 4A illustrates an exploded view of a chemical plasma dispensing unit.

FIG. 4A illustrates an exploded view of a chemical plasma dispensing unit (CPDU) 446A to be installed in the cavity 445. The CPDU 446A is sized and shaped to be embedded and secured in the hollow volume of space of the cavity 445. The CPDU 446A may comprise a chemical plasma reactant (CPR) 465 housed in a cartridge 460 having a volume of space to hold an amount of the CPR 465. The CPR 465 may be stored in the cartridge 460 under low pressure. The cartridge 460 may be an enclosure or housing having a geometric shape that fits within cavity 445. The cartridge 460 has a height H. The cavity 445 has a height or depth which has a height of at least H. In the embodiment of FIG. 4A, the cartridge 460 may have a length which is longer than the width of the cartridge. However, the cavity may be shallow such that the height is shorter while the width may be widened to fit the same quantity of CPR 465.

In some embodiments, a predetermined amount of CPR 465 is distributed around the missile body 110 in CPDUs 446A installed in the cavities 445. Each amount of CPR being capable of producing a certain amount of pressure (P). Therefore, the plurality of CPRs 465 within the selected area (A) may be ignited simultaneously to create a certain amount of force or overpressure. As the missile body moves through air, there may be a general symmetric flow along the body. The overpressure is generated as an asymmetrical amount of flow is created by the reactions of expelled particles of the CPR in proximity to or at a location lagging a location of the ignited CPDUs to cause a steering force as pressure is applied to the body. The CPR 465 includes one or more chemical elements which may produce exothermic reactions in response to excitation of by a current, voltage, or heat to ignite a gasless reaction, for example. Examples of materials are described in "Propagation of Gasless Reactions in Solids-II, Experimental Study of Exothermic Intermetallic Reaction Rates," by A. P. Hardt et al., copyright in 1973. In some embodiments, the intermetallic plasma compounds may include nanoparticles. A few milligrams to a few grams of intermetallic plasma compounds are configured to create large volumes of hot particles and gas reactants.

In some embodiments, hydrogen gas producing reactions may be incorporated into the chemical plasma reactant (CPR) based on energy dense energetics. In some embodiments, the chemical plasma reactions may include liberation of a gaseous reaction product, such as hydrogen." Examples of energy dense energetics of hydrogen gas producing reactions are disclosed in U.S. Pat. No. 7,494,705, titled "HYDRIDE BASED NANO-STRUCTURED ENERGY DENSE ENERGETIC MATERIAL," assigned to Lockheed Martin Corporation, which is incorporated herein by reference. Additionally, the CPR may include high energy chemical reactive mixture with its own reduction agent.

In some embodiments, each cartridge 460 has essentially the same volume of space to store the same amount or quantity (q) of CPR 465. On at least one side of the cartridge 460, the CPDU 446A includes an initiator foil 470A and an initiator connector circuit 475. The initiator connector circuit 475 includes a substrate or circuit board with a flange 485 perpendicular to the board. The flange 485 may support the initiator foil 470A such that the foil 470A and the initiator connector circuit 475 may be generally parallel and may be in direct contact with each other. The width of the flange 485 may also support the width of the cartridge 460 so that the components of the CPDU 446A may be inserted together as a unitary unit into the cavity 445. The initiator connector circuit 475 includes power bars 477. Additionally, the initiator connector circuit 475 may include a contact point 482 centrally positions on the board of the initiator connector circuit 475. By way of non-limiting example, the foil 470A is a pyrotechnic foil which may be an indium based pyrofoil manufactured by Indium Corporation®. For example, the pyrofoil may produce a high heat in a short time such as one or more nanoseconds. Nonetheless, other response times may be used such as approximately 10 m/s (meters/second) reactive foil which is 1 cm/ms (centimeters/millisecond).

In some embodiments, the foil is electrically initiated with an approximately 10-100 m/s detonation velocity. In some embodiments, the foil 470A may be integrated into a wall of the cartridge 460 so that the foil may be in direct contact with the CPR.

The CPDU 446A may include tabs 480A and 480B which may extend perpendicularly below the flange 485. In some embodiments, the electrical tabs 480A and 480B may provide a plug-in or snap-in configuration into the floor (not shown) of the cavity 445. The tabs may be fastened or permanently secured to the cavity. The electric tabs 480A and 480B are configured to receive power from the power supply 135 (FIG. 1).

When the initiator connector circuit 475 is activated, as will be discussed in detail later, current flows to the foil 470A to ignite the CPR 465 in the cartridge 460 over the area or portion of the area of at least one side of the cartridge. The foil 470A may be a thin planar element having an area which corresponds to the area which approximates the area of one side of the cartridge 460. Thus, the foil 470A may heat the CPR 465 across the entire area simultaneously along one side of the cartridge such that the heat would radiate from the foil 470A through the CPR 465 to rapidly ignite the CPR 465 to effectuate a first chemical plasma reaction. The foil 470A may intend to distribute heat to the CPR 465 evenly across the area of the CPR 465 to rapidly ignite the amount of CPR 465 to effectuate the chemical plasma reaction.

The CPR 465 includes energy dense reactive materials which may be ignited and dispersed at fast reactions times along the missile's external surface. The reactive materials add energy into the flow over the missile surface in the forms of hot gas and reactant particles. The energy addition to the flow creates pressure on the missile surface creating a maneuver force. Specifically, the flow around the missile body is heated at the point or area of the chemical plasma reaction caused by the selected area (i.e., area A) of cavities 445 and an area lagging the selected area A as the missile is in motion.

Returning also to FIG. 3A, the embodiments herein select an area A (FIG. 3A) to create a certain amount of overpressure from energy dense high-rate reactions generated by released CPR particles, from the ignited CPR 465, over missile surfaces to create steering forces (i.e., $force_{CPS}$) rather than a reaction mass ejection force (i.e., $force_{ACM}$) from attitude control motors (ACMs). The CPR 465 produces reaction products of added energy into the flow over the missile surface in the forms of hot gas and reactant particles. The energy addition to the flow creates pressure on the exterior surface of the missile body 110 to create a maneuver or steering force (i.e., $force_{CPS}$).

The inventors have determined that reduced missile maneuver time constants may improve hit-to-kill technology. Energy dense reactive materials (i.e., CPR 465) are ignited and dispersed as fast reactions along the exterior surface of the missile body 110. The exterior surface being the skin of the missile exposed directly to the fluid medium such as air through which the missile 100 (FIG. 1) moves. The skin in some embodiments includes the missile coating. The embodiments herein may embed the CPR 465 just below or flush with the plane of the skin during flight. The CPR 465 may be embedded under a coating surrounding the missile body 110.

Figure 4B:
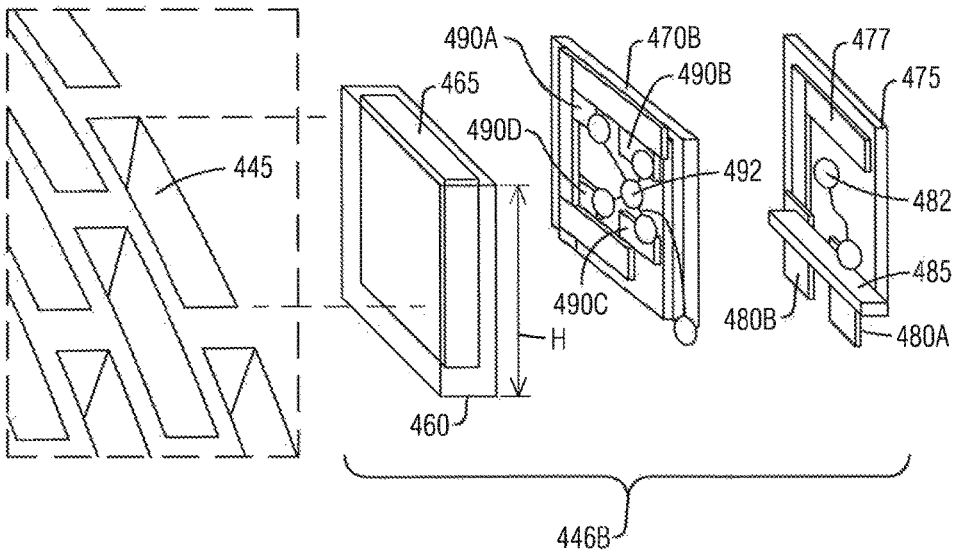
FIG. 4B illustrates an exploded view of another chemical plasma dispensing unit.

FIG. 4B illustrates an exploded view of another CPDU 446B. The CPDU 446B is similar to CPDU 446A. Thus, only the differences will be described in detail for the sake of brevity. In lieu of a foil 470A, a multi-point initiator 470B may be provided. The multi-point initiator 470B may be on a wafer circuit board having a plurality of initiator charges 490A, 490B, 490C, and 490D, each of which is coupled to electric via lines 492. In some embodiments, the multi-point initiator 470B includes four initiator charges distributed approximately equidistant from each other to allow the CPR 465 to be initiated at different points simultaneously to rapidly ignite to effectuate a chemical plasma reaction.

In some embodiments, the rate of reaction of each CPDU 446B may be varied wherein each multi-point initiator 470B may be individually addressable by separate electrical wires. Thus, depending on the number of initiator charges 490A, 490B, 490C, and 490D activated, the rate of reaction by the CPR would be varied. For example, activating all charges 490A, 490B, 490C, and 490D may produce a faster rate of reaction by the CPR than activating only one charge. Activating two charges may allow the CPR to have a faster rate of activation than the reaction of one charge but a slower rate of four charges, for example.

In some embodiments, a wall of the cartridge 460 may have the multi-point initiator 470B integrated therein.

Figure 4C:
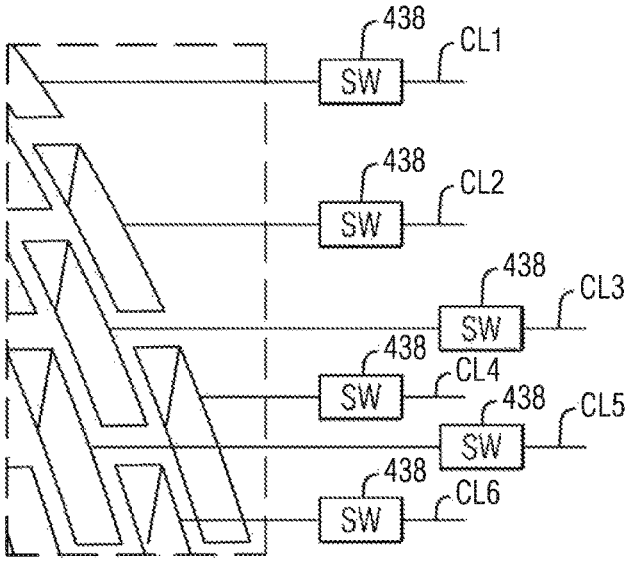
FIG. 4C illustrates a partial view of the chemical plasma steering segment.

FIG. 4C illustrates a partial view of the chemical plasma steering segment. Each cavity, and more importantly, may be connected to the power supply 135 (FIG. 1) via a plurality of individually addressable switches 438. Power is delivered on a plurality of lines CL1, CL2, CL3, CL4, CL5, and CL6. As shown, the number of lines would be a function of the number of cavities and CPDU 446A or 446B. By way of non-limiting example, the switches 438 may be individually addressable by CD 150 (FIG. 1) or processor.

Figure 8:
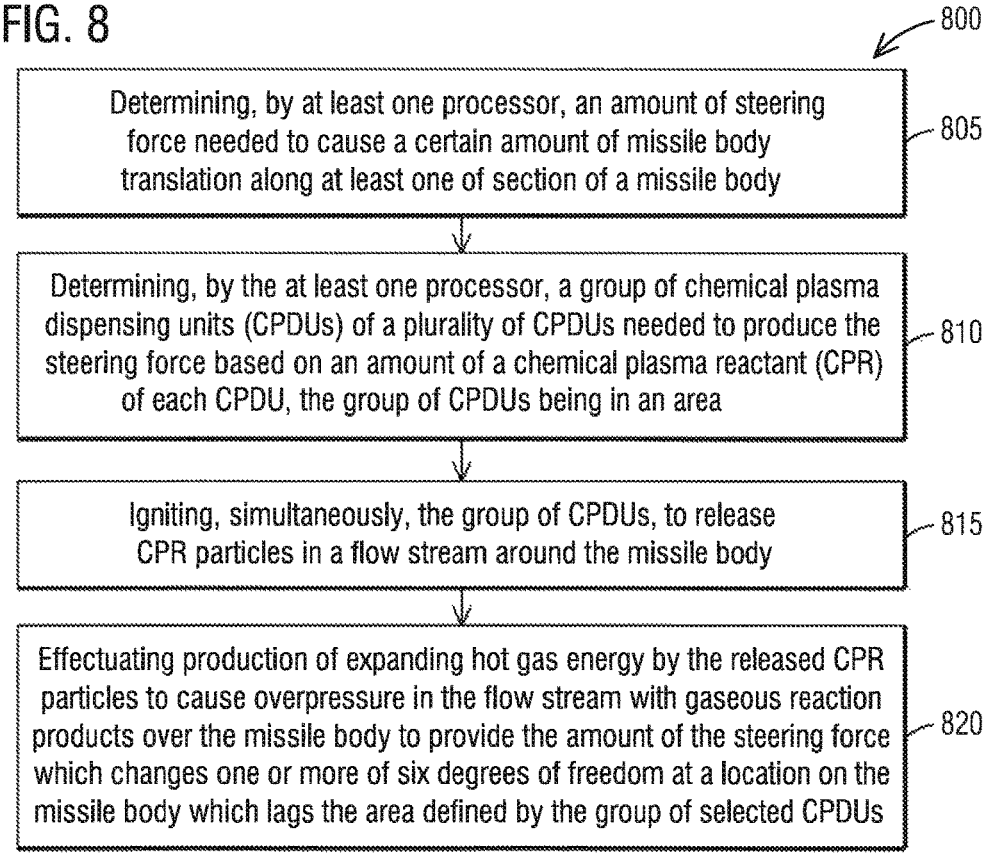
FIG. 8 illustrates a flowchart of a method for missile steering.

FIG. 8 illustrates a flowchart of a method 800 for missile steering. The blocks shown in the method 800 may be performed in the order shown or in a different order. One or more of the block may be performed contemporaneously. Blocks may be added or deleted.

The method 800 may include, at block 805, determining, by at least one processor (i.e., computing device 150), an amount of steering force or maneuvering force ($force_{CPS}$) needed to cause a certain amount of missile body translation along at least one section of a missile body. The steering force may be for an angle of attack (AoA) or translation maneuver of the missile body 110 during flight. While not shown, the method 800 may include, before block 805 and during or after any blocks of method 800, determining forces by ACM devices during the flight of the missile. Furthermore, the amount of steering force or maneuvering force may be determined for one or more segments placed along the missile body 110, simultaneously. An aft section steering force may be determined. A forward section steering force may be determined. A control surface steering force may be determined. Thus, when determining an amount of steering force or maneuvering force, a plurality of steering forces for multiple locations on the missile body may be determined simultaneously or near simultaneously.

At block 810, the method 800 includes determining, by the at least one processor, a group of chemical plasma dispensing units (CPDUs) of a plurality of CPDUs needed to produce the steering force based on an amount of a chemical plasma reactant (CPR) of each CPDU. The determining at block 810 may determine an area A in the segment with a quantity of CPR in a group of CPDUs to produce the desire maneuvering $force_{CPS}$ Each CPR has a predetermined amount of chemical mixture engineered to create an amount of energy in the second reaction. In some embodiments, the group of selected CPDUs includes CPDUs selected in a pattern within an area such that not all CPDUs bounded within the area are selected. In the pattern, the group of selected CPDUs is interspersed among non-selected CPDUs of the area. Thus, remaining un-ignited CPDUs in the selected area are available for subsequent activation for another steering force creation. In some embodiments, the area for a steering force may be identified based on the remaining non-ignited CPDUs at a subsequent point in time for an angle of attack (AoA) or translation maneuver. At block 815, the method includes igniting, simultaneously, the group of CPDUs, to release CPR particles in a flow stream around the missile body. The computing device 150 may activate individually switches 438 to activate the foil 470A or multi-point initiator 470B of those CPDUs in the area A. At block 820, the method includes effectuating production of expanding hot gas energy by the released CPR particles to cause overpressure in the flow stream with gaseous reaction products over the missile body to provide the amount of the steering force which changes one or more of six degrees of freedom at a location on the missile body. The material of the CPR 465 is ignited to effectuation a first reaction. The released CPR particles complete a second reaction in the flow stream over a reaction time period to effectuate production of expanding hot gas energy caused by heating air in the flow stream and gaseous reaction products over the missile body to provide an amount of a steering force to change one or more of six degrees of freedom at a location on the missile body. This second reaction produces the overpressure in the flow stream over the missile body to apply pressure on the missile body at a location which lags the area defining the group of selected CPDUs.

By way of non-limiting example, the CPR 465 may be a propellant having an energy density in the dispensed reactives over the missile surfaces of 28 kJ/cc (kilojoules/cubic centimeter) or 8 kJ/gram. Converting only 10 percent of this energetic to expanding gas energy may beat equivalent electrically driven chemical plasma steering (Electrical pulsed power limit ~0.1 Joule/cc). The CPR 465 may use energy dense powder reactants. Electrical energy may be a pulsed power volume in an airframe (e.g., <0.1 Joule/cc) where cc is a cubic centimeter. Chemical plasma dispensing unit may require less electronic ignition (e.g. 10 Joule ignition).

The CPR 465 can be held in a shallow cavity. This would allow placement of these "external chemical plasma dispensing units" closer in to the external surface (skin) of the missile body 110. The powders of the CPR 465 could be placed in planar volumes distributed along the skin of the missile body 110, and released just forward of the center of gravity 102, providing a $force_{CPS}$ with a translational push "sideways" that can be utilized in the end game (i.e., angle of attack (AoA)) for hit-to-kill technology.

The CPDU may generate orders of magnitude more heated gases along aerodynamic surfaces of the missile body 110 than electrical discharges. In some embodiments described herein, chemical plasma reactant particles, caused by the burning, reaction or igniting of each CPR 465 of a group of CPDUs are distributed into the flow stream volume, may be in the temperature range of approximately 3000° K to 5000° K (Kelvin). The flow stream volume being in proximity to the area of the group of individually addressable CPDUs being ignited. Then, secondary reactions from these reactant particles, caused by the burning or igniting of CPR 465, may create additional hot gases to increase pressure in a given volume of space. Because the missile is in motion, the point of pressure applied on the missile body may be lag the location from which the CPRs were ignited. In some embodiments, the reaction time period of the second reaction may be less than 100 μsec. By way of non-limiting example, for a reaction time of 100 μsec, the pressure of the steering force may be applied at a location which is approximately 10 cm behind the area of the selected CPDUs. CPRs which have particles with a shorter reaction time may cause the pressure of the steering force to be applied at a location which is closer to the area of the selected CPDUs.

External force generation, caused by the group of selected CPDUs, may expand gases from along external surfaces of the missile body 110. The CPR 465 may be dispersed under lower pressures. Lower pressure containment (i.e., cartridge 460) allows thinner and shallower propellant storage. The large number of CPDUs allows integration of the chemical plasma steering system with existing aerodynamic and attitude control motor (ACM) controls.

In summary, the plurality of chemical plasma dispensing units (CPDUs) described herein have a chemical plasma reactant (CPR) of a certain quantity. Each respective CPDU being coupled in a respective cavity and individually addressable so that a group of selected CPDUs in an area is ignited simultaneously to cause a first reaction to push CPR particles through the openings of the cavities housing the selected CPDUs and into a flow stream surrounding the missile body. Then the CPR particles complete a second reaction in the flow stream over a reaction time period (less than 100 μsec) to effectuate production of expanding hot gas energy caused by heating air in the flow stream and gaseous reaction products over the missile body to provide an amount of a steering force to change one or more of six degrees of freedom at a location on the missile body which lags the area defined by the group of selected CPDUs.

The CPRs 465 may be distributed circumferentially around the missile body and/or over the center of gravity can induce translation for end game maneuvers. The chemical plasma steering (CPS) segment 140 over tail areas in coordination with forward ACM operation can be used to generate translation.

Performance improvement may be achieved by reducing the time required to develop hit-to-kill miss distances. This time reduction translates into a shorter acquisition and tracking range requirements for active and passive missile seekers.

Reactant Powder Required to Create Force$_{CPS}$ ($F_{CPS}$)

The surface area (SA) of a missile body 110 for the chemical plasma steering system may be determined based on the size of the missile body. When forming the CPS segment 340, the CPR 465 is determined and the area to be used in the missile body 110.

The surface area (SA) may be calculated by the circumference of the missile times the length of the chemical plasma steering (CPS) segment of the missile. The length of the missile is L-M while the length of the CPS segment is denoted as L-CPS.

Example I

For the purpose of evaluation, the circumference (C) of the missile body 110 is determined where the circumference is defined by equation Eq(3) where $$\text{Circumference}=\pi\times\text{diameter } (D). \qquad \text{Eq(3)}$$

For a 5 inch diameter (D) missile body 110, and length L-CPS of 0.5 m=19.685 inches, then the circumference=0.399 m (meter) wherein the parameter Z is defined by equation Eq(4) where $$Z=\text{length}\times\text{circumference}=0.199\ \text{m}^2. \qquad \text{Eq(4)}$$

Assume that the surface area subject to pressure (P) is set to ⅙, then the area (A) for a predetermined amount of pressure is defined by equation Eq(5) where $$\text{Area } (A)=\tfrac{1}{6}\times\text{parameter } Z=0.033\ \text{m}^2. \qquad \text{Eq(5)}$$

The pressure (P), needed for a Force$_{CPS}$=150 lbf (pound-force), can be calculated based on equation E(6) where $$\text{Pressure } (P) = \frac{\text{Force}}{\text{Area}} = 2.911\ \text{psi (pound per square inch).} \qquad \text{Eq (6)}$$

By way of example, an ACM device may operate at 8 ms at 150 lbf. Then, if chemical plasma flow is set to approximately 1 m/ms (lkm/sec), by way of non-limiting example, then for 0.5 meter length, 8×Force$_{CPS}$ in 1 ms (millisecond) equals 8 ms at 150 lbf. Therefore the pressure equation adjusted for time is defined by equation Eq(7) where $$\text{Pressure} = \frac{8\times\text{Force}}{\text{Area}} = 23.285\ \text{psi.} \qquad \text{Eq (7)}$$

Thus, pressure=0.161 J/cm$^3$.

The CPR 465 parameters will now be described. The quantity (q) for the CPR 465 needed such as for 0.08 J/cm$^3$ (Joules/centimeter$^3$) in volume of 10 cm layer of CPR 465 over pressurized area may be q=8 kJ/gm such as for Ta (Tantalum)+2B (Boron) powder. The volume (V) of CPR 465 needed for an amount of pressure is defined by equation Eq(8) where $$\text{Volume } (V)=10\ \text{cm}\times\text{Area } (A) \text{ where}$$

$$\text{Volume } (V)=3.325\times10^3\ \text{cm}^3 \text{ where kJ}=10^3\ \text{J.} \qquad \text{Eq(8)}$$

Therefore, the Energy required ($E_{req}$) per CPDU may be defined by equation Eq(9) where $$E_{req}=\text{Pressure}\times\text{Volume}=533.787\ \text{J.} \qquad \text{Eq(9)}$$

Volume requirements for each thin shallow grooves or cavities 445 in the chemical plasma steering (CPS) segment 140 of the missile body 110 may be determined based on the specific chemical plasma reactant in the cavity 445, as each reactant would produce a different force effect (i.e., translation or hit to kill maneuver). The mass required Mass$_{req}$ is defined by equation Eq(10) where $$\text{Mass}_{req} = \frac{E(req)}{q} = 0.067\ \text{gm (grams).} \qquad \text{Eq (10)}$$

If the reaction is 10% efficient then $$\text{Mass}_{10\%} = \frac{E(req)}{10\% \times q} = 0.667 \text{ gm.}$$

If the reaction is 5% efficient then $$\text{Mass}_{5\%} = \frac{E(req)}{5\% \times q} = 1.334 \text{ gm.}$$

Therefore, the number of grams of CPR 465 can be determined. Based on the number of grams of the CPR 465 in a cartridge 460, the pressure, and force needed, the volume or area of CPR 465 to produce the force may be determined by the computing device (CD) 150. The size of the cavity and the amount of CPR 465 may be varied to produce a force at a determined location on the missile body 110 to effectuate change (i.e., translation or hit to kill maneuver) in one or more of the six degrees of freedom of the missile body 110 during flight.

Example II

Using the equations above, for a 5 inch diameter D missile body 110; L-CPS of 1 m=39.37 inches; Circumference=0.399 m; and parameter Z=Length×Circumference=0.399 $m^2$. Assume that the surface subject to pressure is set to ¼, then the Area=¼×parameter Z=0.1 $m^2$. The pressure needed for 150 lbf (pound force) can be calculated as Pressure=0.97 psi.

If flow is set to approximately 1 m/ms (lkm/sec) then for 1 meter length−8× force in 1 ms (millisecond) to equal 8 ms at 150 lbf. Thus, pressure=7.762 psi or pressure=0.054 $J/cm^3$.

The CPR 465 is needed for 0.054 J/cm3 in volume of 20 cm Layer over pressurized area. Therefore, quantity q=8 kJ/gm for Ta+2B powder with a volume=20 cm×Area=$1.995\times10^4$ $cm^3$ where kJ=$10^3$J. Thus, the Energy required ($E_{req}$)=$1.068\times10^3$ J with the $\text{Mass}_{req}$=0.133 gm. If the reaction is 10% efficient then $\text{Mass}_{10\%}$=1.334 gm. If the reaction is 2% efficient then $\text{Mass}_2$=6.672 gm.

Example III

Using the equations above, for a CPR 465 of $TiB_2$ the quantity (q) may be equal to 2.76 $gm/cm^3$ where Ti is Titanium and B is Boron. For a 5% efficient reaction for air heating, the $\text{Mass}_{req}$=1.334 gm. $\text{Mass}_{5\%}$=0.484 $cm^3$. Assume a cartridge for cavity 445 supports a volume of space having a width of 0.25 cm, a length of 5 cm, and a depth or height of 0.5 cm. Thus, the volume of CPR 465 may be 0.625 $cm^3$ per cavity.

By way of example, for a 20% spacing circumferentially around a 5 inch diameter missile body would allow for approximately six (6) CPDUs to be arranged in a single ring. The 20% spacing may correspond to the amount of spacing between cavities to separate one cavity from another in the same ring and/or adjacent rings. Thus, for 20 side-by-side rings, the number of cavities 445 in the CPS segment 340 may be 120. For a CPS segment 340 with 40 rings, the number of cavities 445 in a CPS segment 340 may be 240.

Example IV

Assume a missile diameter of 14 inches, a ⅓ surface area (SA) subject to pressure and force of 6300 lbf (pounds-force).

To determine an example reaction time, then the $\text{length}_{react}$ is defined by equation Eq(11) where $$\text{Length}_{react}=\text{diameter } (D)\times\text{surface area (SA)} \qquad \text{Eq(11)}$$

where $\text{length}_{react}$=0.119 m.

The equation Eq(12) to determine a reaction time $\text{time}_{react}$ is defined by $$\text{Time}_{react}=\text{Length}_{react}/\text{flow rate} \qquad \text{Eq(12)}$$

where the flow rate is approximately 1 km/s and the $\text{Time}_{react}$=0.119 ms. Then for a 150 lbf with a 5 ms over thrust to match 5 ms of ACM device, $\text{Force}_{CPS}$=$6.3\times10^3$ lbf (6300 lbf).

The next determination is how much CPR is necessary to create such a force.

Example V

Assume a diameter of 5 inches, ⅙ surface area (SA) subject with a pressure of 6300 lbf at 0.119 ms. Then, area (A) may be calculated according to equation Eq(13) where $$\text{Area } (A)=\tfrac{1}{6}\times\text{Circumference}\times\text{Length}_{react} \qquad \text{Eq(13)}$$

where area (A) approximately equal to 78.91 cm2; pressure=515.083 psi; and pressure=3.551 $J/cm^3$ for an energy density in air volume at pressure.

The CPR needed for 3.551 J/cm3 in a volume of 5 cm layer over pressurized surface area provides a quantity of 10 kJ/gm. By way of non-limiting example, quantity 1 may include Ti (Titanium)+C (Carbon) (TiC) which produces 8 kJ/cc. Another example, quantity 2 may include Ti+2B (TiB2) which is greater than 10 kJ/cc. For a Volume of 5 cm×area=394.549 $cm^3$. The $\text{Energy}_{req}$ (E) 1.401 kJ. The $\text{Mass}_{req}$=0.14 gm. For a reaction which is 30% efficient, the $\text{Mass}_{30\%}$=0.467 gm. For a reaction which is 15% efficient, the $\text{Mass}_{15\%}$=0.934 gm. For a reaction which is 10% efficient, the $\text{Mass}_{10\%}$=1.401 gm. For a reaction which is 5% efficient, the $\text{Mass}_{5\%}$=2.802 gm.

The spacing between cavities 445 and the volume of the cartridge for CPR 465 may be varied to achieve the maneuverability and translation required for the intended purpose of the missile 100. Therefore, the number of CPDUs may vary as result of the missile diameter. As can be seen from the Example I-V, the CPR 465 needed for a particular force is in the grams which is far lower in weight than the used for known ACM devices which also requires containment chambers for an explosive reaction to occur therein.

In some embodiments, the CPDUs could be embedded in the missile body skin such as to populate an ogive shoulder of a cylindrical body of the missile. Additionally, the CPDUs may be added throughout the missile body skin such as along the base of the nose cone, until constrained by interference with guidance seeker. The large numbers of CPDUs may replace low dynamic response tail control thrust vectoring.

The CPDUs could be fired to give the best translational motion or angle of attack (AoA) desired at a given time in the flight. The CPDUs nearest the center of gravity 102 would provide the translational steering forces, while the forward or rearmost CPDUs on the missile body 110 could provide fast angle of attack responses.

Like other ACM systems, multiple CPDUs can be fired simultaneously; and greater forces may be generated by simultaneous firing of forward and/or rearward ACM devices to generate additional translational force at low angle of attack (AoA).

The analysis supports dense energetics, deployed as external CPDUs, may exceed the steering force achieved by ACM devices while liberating volume in the missile body previously occupied by ACM pressure containment structures. Inventors project a 20% reduction in maneuvering time constant ($t_{msl}$) from 0.5 s (2 Hz) to 0.4 s (2.5 Hz) and a reduced detection range requirement by ~52%. The reduced detection range requirement may relax the radar power requirement by ~1/20, or ~13 dB less power.

Figure 5:
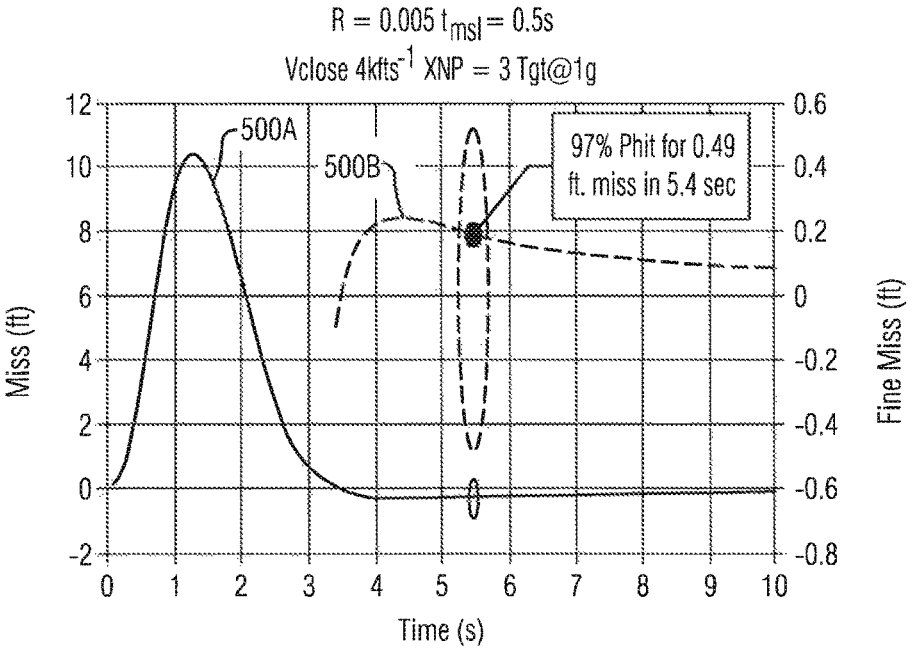
FIG. 5 illustrates a graphical representation of a first curve representing miss in feet verses time and a second curve being a fine miss in feet verses time.
Figure 6:
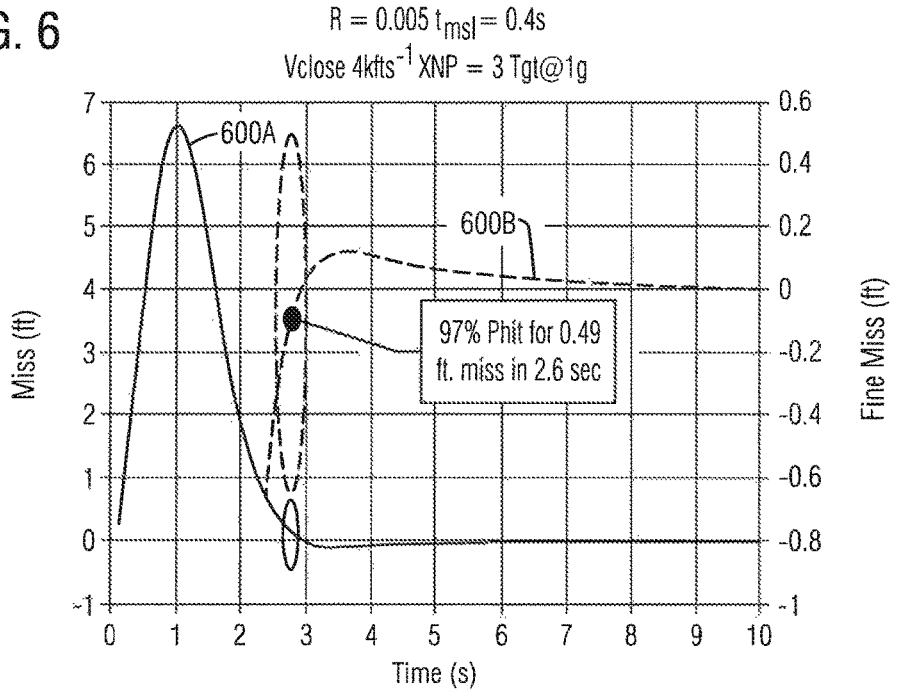
FIG. 6 illustrates a graphical representation of a first curve representing miss in feet verses time and a second curve being a fine miss in feet verses time.

FIG. 5 illustrates a graphical representation of a first curve 500A representing miss in feet verses time and a second curve 500B representing a fine miss in feet verses time. The curves in FIGS. 5 and 6 are generated for a radar type seeker used in the missile. The curves may vary based on the type of seeker used. The curves illustrate a point where there is a 97% probability of a hit ($P_{hit}$) at 0.49 ft. miss in 5.4 seconds. The curves are based on a Radome error slope (R)=0.005; maneuvering time constant ($t_{msl}$)=0.5 seconds; a closing velocity ($V_{close}$) of 4 kft/s XNP=3; and a target at 1 g (where g is acceleration due to gravity). The term $t_{msl}$ is the missile maneuver time constant in seconds; XNP is the navigation ratio, or the effective Kalman filter gain; $V_{close}$ is the closing velocity between a target and the missile; Tgt@1 g is the target maneuvering at 1 g (acceleration due to gravity) across the range shown in the Y-axis. The miss distance is also cross-range in the plots of the curves shown. The inventor has determined that a reduction in the time constant by 20 percent may generate an advantage in the Radome error slope.

FIG. 6 illustrates a graphical representation of a first curve 600A representing miss in feet verses time and a second curve 600B representing a fine miss in feet verses time. As can be seen from FIGS. 5 and 6, there is a shorter maneuvering time constant ($t_{msl}$). The time constant $t_{msl}$ in FIG. 6 is 0.4 seconds. Thus, the time constant is decreased. The curves illustrate a point where there is a 97% probability of hit ($P_{hit}$) for 0.49 ft. miss in 2.6 seconds. Additionally, translational motion improves the probability of kill ($P_k$) at a given probability of hit ($P_{hit}$) while reducing steering costs.

Figure 7:
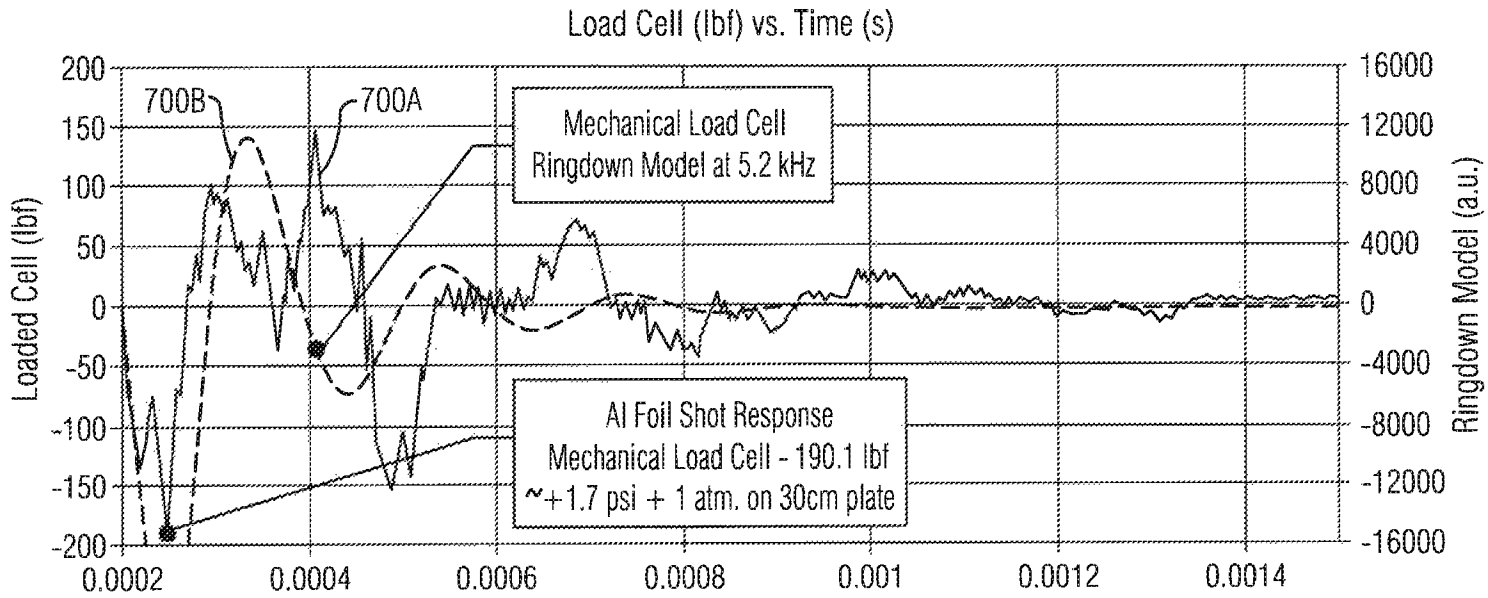
FIG. 7 illustrates a graphical representation curve of a load cell (lbf) verses time in seconds and a graphical representation curve of a ringdown model (a.u) verses time in seconds.

FIG. 7 illustrates a graphical representation curve 700A of a load cell (lbf) verses time in seconds and a graphical representation curve 700B of a ringdown model in arbitrary units (a.u.) verses time in seconds. The force measurements are in arbitrary units, as these are scaled via modeling and integration post measurement. The curve 700A represents modeling in MathCAD for energy deposition by partial vaporization of Aluminum (Al) foil strips generating exothermic $Al_2O_3$ reaction. The load cell had approximately 5 kHz response. Therefore, the 100 μsec reaction impulse was integrated by a force sensor, reducing the measured peak to approximately 200 lb. The actual force was approximately 400 lbf in 100 μsec. The curve 700A represents a measure of reactants over a pressure plate. By way of example, an Aluminum (Al) foil shot response has a mechanical load cell of 190 lbf with approximately 1.7 psi overpressure on a 30 cm pressure plate. The curve 700B is a mechanical load cell of a ringdown model at 5.2 kHz. The gas generating reactions in some embodiments may be endo-atmospheric or exo-atmospheric.

Figure 9:
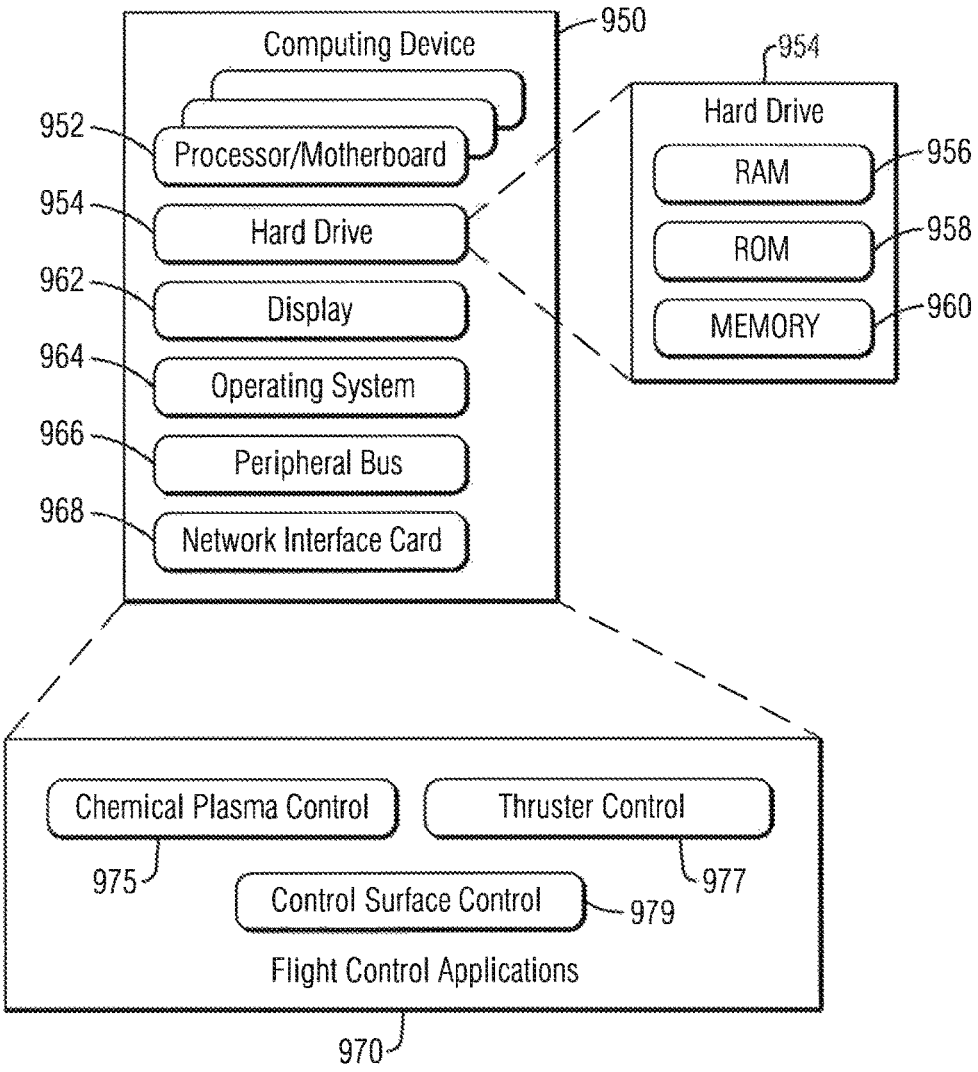
FIG. 9 illustrates a block diagram of an embodiment of a computing system useful for implementing an embodiment disclosed herein.

Referring now to FIG. 9, a block diagram of an embodiment of a computer device (CD) 950 useful for implementing various aspects the processes disclosed herein is shown. The computing device 950 may include one or more processors 952 and system memory in hard drive 954. Depending on the exact configuration and type of computing device, system memory may be volatile (such as RAM 956), non-volatile (such as read only memory (ROM 958), flash memory 960, and the like) or some combination thereof. System memory may store operating system 964, one or more applications, and may include program data for performing image processing, inertial measurements for pitch, yaw and roll and axial motions, and angle of attack (AoA) calculations for a hit to kill maneuver. The computing device 950 may determine the six degrees of freedom. The computing device 950 may determine the area A, the number of CPDUs that need to be ignited simultaneously in an area to effectuate the translation or hit to kill endgame maneuver, and the pattern of the CPDUs in the area. The computing device 950 may perform one or more blocks of method 800.

The computing device 950 may include flight control application 970 to control the operation of the missile 100 such as by way of steer the missile. By way of non-limiting example, the flight control application 970 may include modules for chemical plasma control 975 and thruster control 977. In some embodiments, the flight control application 970 may include control surface control 979. In some embodiments, one or more ACM devices 127A may be replaced with canards, another CPS segment 140, or portion of a CPS segment 140. The chemical plasma control 975 may control steering in the aft section, forward section, or nose section of the missile body 110. In some embodiments, the chemical plasma control 975 may be extended to the control surfaces wherein the control surfaces may include a segment with embedded cavities and a CPDU installed in each cavity. The steering forces contributed by the control surfaces may be controlled by selecting an amount of CPR reactant needed for the steering force and igniting a pattern of CPDUs to expel an amount of CPR particles. Thus, the chemical plasma steering (CPS) segment 140 may include a segment which conforms to the shape of the control surface or other missile surface.

Computing device 950 may include one or more processor 952 for executing instructions described herein. The computing device 950 may also have additional features or functionality. For example, computing device 950 may include additional data storage devices (removable and/or non-removable) such as, for example, magnetic disks, optical disks, or tape. Computer storage media may include volatile and non-volatile, non-transitory, removable and non-removable media implemented in any method or technology for storage of data, such as computer readable instructions, data structures, program modules or other data. System memory, removable storage, and non-removable storage are all examples of computer storage media. Computer storage media includes, but is not limited to, RAM, ROM, Electrically Erasable Read-Only Memory (EEPROM), flash memory or other memory technology, compact-disc-read-only memory (CD-ROM), digital versatile disks (DVD) or other optical storage, magnetic cassettes, magnetic tape, magnetic disk storage or other magnetic storage devices, or any other physical medium which can be used to store the desired data and which can be accessed by computing device. Any such computer storage media may be part of device.

Computing device 950 may also include or have interfaces for input device(s) (not shown) such as a keyboard, mouse, pen, voice input device, touch input device, etc. The computing device 950 may include or have interfaces for connection to output device(s) such as a display 962, speakers, etc. The computing device 950 may include a peripheral bus 966 for connecting to peripherals. Computing device 950 may contain communication connection(s) that allow the device to communicate with other computing devices, such as over a network or a wireless network. By way of example, and not limitation, communication connection(s) may include wired media such as a wired network or direct-wired connection, and wireless media such as acoustic, radio frequency (RF), infrared and other wireless media. The computing device 950 may include a network interface card 968 to connect (wired or wireless) to a network.

Computer program code for carrying out operations described above may be written in a variety of programming languages, including but not limited to a high-level programming language, such as C or C++, for development convenience. In addition, computer program code for carrying out operations of embodiments described herein may also be written in other programming languages, such as, but not limited to, interpreted languages. Some modules or routines may be written in assembly language or even micro-code to enhance performance and/or memory usage. It will be further appreciated that the functionality of any or all of the program modules may also be implemented using discrete hardware components, one or more application specific integrated circuits (ASICs), or a programmed Digital Signal Processor (DSP) or microcontroller. A code in which a program of the embodiments is described can be included as a firmware in a RAM, a ROM and a flash memory. Otherwise, the code can be stored in a tangible computer-readable storage medium such as a magnetic tape, a flexible disc, a hard disc, a compact disc, a photo-magnetic disc, and a digital versatile disc (DVD).

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While various disclosed embodiments have been described above, it should be understood that they have been presented by way of example only, and not limitation. Numerous changes, omissions and/or additions to the subject matter disclosed herein can be made in accordance with the embodiments disclosed herein without departing from the spirit or scope of the embodiments. Also, equivalents may be substituted for elements thereof without departing from the spirit and scope of the embodiments. In addition, while a particular feature may have been disclosed with respect to only one of several implementations, such feature may be combined with one or more other features of the other implementations as may be desired and advantageous for any given or particular application. Furthermore, many modifications may be made to adapt a particular situation or material to the teachings of the embodiments without departing from the scope thereof.

Therefore, the breadth and scope of the subject matter provided herein should not be limited by any of the above explicitly described embodiments. Rather, the scope of the embodiments should be defined in accordance with the following claims and their equivalents.

What is claimed is:

1. A system comprising:

a missile segment having an external surface conforming to an external surface of a portion of a missile body, the missile segment comprising:

a plurality of shallow cavities arranged in the external surface of the portion of the missile body and each cavity having an opening; and a plurality of chemical plasma dispensing units (CPDUs) having a chemical plasma reactant (CPR), each respective CPDU being coupled in a respective cavity and being individually addressable so that a group of selected CPDUs in an area is ignited simultaneously to cause a first reaction to push CPR particles into a flow stream surrounding the missile body, the CPR particles to complete a second reaction in the flow stream over a reaction time period to effectuate production of expanding hot gas energy caused by heating air in the flow stream and gaseous reaction products over the missile body to provide an amount of a steering force to change one or more of six degrees of freedom at a location on the missile body which lags the area defined by the group of selected CPDUs.

2. The system according to claim 1, further comprising a computing device configured to determine the group of selected CPDUs to control the one or more of six degrees of freedom defining the location on the missile body to produce the steering force for an angle of attack.

3. The system according to claim 1, wherein the CPDU comprises:

a cartridge having a volume of space defined by a plurality of walls forming an enclosure to store the CPR within the enclosure; and a pyrotechnic foil covering a wall of the cartridge to apply an activation response to an area of the CPR, the area of the CPR being in contact with the wall.

4. The system according to claim 1, wherein the CPDU comprises:

a cartridge having a volume of space defined by a plurality of walls forming an enclosure to store the CPR within the enclosure; and an initiator comprising multiple points of activation, the initiator being coupled a wall of the cartridge to activate one or more of the multiple points of activation to ignite the CPR.

5. The system according to claim 4, wherein a number of the multiple points of activation selected to ignite the CPR varies a rate at which a quantity of the CPR activates.

6. The system according to claim 1, wherein the CPR comprises a composition of Tantalum and Boron, Titanium and Boron or Titanium and Carbon.

7. The system according to claim 1, further comprising at least one power source to ignite the group of the selected CPDUs, wherein the group of selected CPDUs being arranged in a pattern interspersed among non-selected CPDUs in the area.

8. A missile comprising:

a missile body having a nose section, a forward section, an aft section and a tail section;

a computing device configured to control steering of the missile body in air; and at least one missile segment comprising an external surface conforming to an external surface of the missile body, the at least one missile segment being integrated in the missile body, the at least one missile segment comprising:

a plurality of chemical plasma dispensing units (CPDUs) embedded in the external surface of the at least one missile segment and having a chemical plasma reactant (CPR), each respective CPDU being individually addressable so that a group of selected CPDUs in an area is ignited simultaneously to effectuate production of expanding hot gas energy to cause overpressure in a flow stream with gaseous reaction products over the missile body to provide an amount of a steering force to change one or more of six degrees of freedom at a location on the missile body which lags the area defined by the group of selected CPDUs.

9. The missile according to claim 8, further comprising a plurality of shallow cavities arranged in a plurality of cavity sets, each cavity set being arranged circumferentially around the hollow cylindrical body wherein each respective cavity has a respective CPDU embedded therein; and the computing device configured to determine the group of selected CPDUs to control the one or more of six degrees of freedom defining the location on the missile body to produce a maneuver for an angle of attack.

10. The missile according to claim 8, wherein said each CPDU comprises:

a cartridge having a volume of space defined by a plurality of walls forming an enclosure to store the CPR within the enclosure; and a pyrotechnic foil covering a wall of the cartridge to apply an activation response to an area of the CPR, the area of the CPR being in contact with the wall.

11. The missile according to claim 8, wherein said each CPDU comprises:

a cartridge having a volume of space defined by a plurality of walls forming an enclosure to store the CPR within the enclosure; and an initiator comprising multiple points of activation, the initiator being coupled to a wall of the cartridge to activate one or more of the multiple points of activation to ignite the CPR.

12. The missile according to claim 11, wherein a number of the multiple points of activation selected to ignite the CPR varies a rate at which a quantity of the CPR activates.

13. The missile according to claim 8, wherein the group of selected CPDUs are ignited simultaneously to cause a first reaction to push an amount of CPR particles into the flow stream surrounding the missile body, the CPR particles to complete a second reaction in the flow stream over a reaction time period to effectuate the production of the expanding hot gas energy.

14. The missile according to claim 8, further comprising at least one power source to ignite the group of CPDUs; and a plurality of switches coupled to the plurality of CPDUs and the at least one power source wherein activation of a respective one switch individually addresses a respective one CPDU.

15. A method comprising:

determining, by at least one processor, an amount of steering force needed to cause a certain amount of missile body translation along at least one of section of a missile body;

determining, by the at least one processor, a group of chemical plasma dispensing units (CPDUs) of a plurality of CPDUs needed to produce the steering force based on an amount of a chemical plasma reactant (CPR) of each CPDU, the group of CPDUs being in an area;

igniting, simultaneously, the group of CPDUs, to release CPR particles in a flow stream around the missile body; and effectuating production of expanding hot gas energy by the released CPR particles to cause overpressure in the flow stream with gaseous reaction products over the missile body to provide the amount of the steering force which changes one or more of six degrees of freedom at a location on the missile body which lags the area defined by the group of selected CPDUs.

16. The method according to claim 15, further comprising determining, by the at least one processor, a translation force by attitude control motors (ACM) devices to control flight of the missile body.

17. The method according to claim 15, wherein said each CPDU comprises:

a cartridge having a volume of space defined by a plurality of walls forming an enclosure to store the CPR within the enclosure; and a pyrotechnic foil covering a wall of the cartridge to apply an activation response to an area of the CPR, the area of the CPR being in contact with the wall; and further comprising activating the foil to ignite the CPR of said each CPDU in the group of CPDUs.

18. The method according to claim 15, wherein said each CPDU comprises:

a cartridge having a volume of space defined by a plurality of walls forming an enclosure to store the CPR within the enclosure; and an initiator coupled a wall of the cartridge to apply multiple points of activation to the CPR, simultaneously; and further comprising activating one or more of the multiple points of activation to ignite the CPR.

19. The method according to claim 15, wherein the determining of the group of CPDUs includes determining the area with a set of CPDUs; and selecting a pattern of CPDUs from the set of CPDUs so that the pattern of CPDUs is interspersed among non-selected CPDUs in the area.

20. The method according to claim 15, wherein, the effectuating production of expanding hot gas energy, includes causing a first reaction to push an amount of the CPR particles into the flow stream surrounding the missile body; and completing by the CPR particles a second reaction in the flow stream over a reaction time period to effectuate the production of the expanding hot gas energy.

* * * * *